US011052295B2

(12) United States Patent
Seagram

(10) Patent No.: US 11,052,295 B2
(45) Date of Patent: Jul. 6, 2021

(54) TRUSSES FOR GOLF CLUB HEADS

(71) Applicant: Dunlop Sports Co., Ltd., Kobe (JP)

(72) Inventor: Phillip C. Seagram, Huntington Beach, CA (US)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 15/831,021

(22) Filed: Dec. 4, 2017

(65) Prior Publication Data

US 2018/0085642 A1 Mar. 29, 2018

Related U.S. Application Data

(63) Continuation of application No. 14/310,718, filed on Jun. 20, 2014, now Pat. No. 9,849,355.

(51) Int. Cl.
*A63B 53/04* (2015.01)

(52) U.S. Cl.
CPC ..... *A63B 53/047* (2013.01); *A63B 53/0408* (2020.08); *A63B 53/0454* (2020.08); *A63B 2053/0491* (2013.01)

(58) Field of Classification Search
CPC ..... A63B 53/047; A63B 2053/0454
USPC ..... 473/350
See application file for complete search history.

(56) References Cited

U.S. PATENT DOCUMENTS 4,826,172 A * 5/1989 Antonious ..... A63B 53/04 473/350
4,883,274 A * 11/1989 Hsien ..... A63B 53/04 473/335
4,938,470 A * 7/1990 Antonious ..... A63B 53/04 473/242
5,014,993 A * 5/1991 Antonious ..... A63B 53/04 473/350
5,048,835 A * 9/1991 Gorman ..... A63B 53/04 473/350
5,082,278 A * 1/1992 Hsien ..... A63B 53/04 473/242

(Continued)

OTHER PUBLICATIONS

PF Products Finishing, PING Stays Away from the Rough, https://www.pfonline.com/articles/ping-stays-away-from-the-rough, Mar. 2000.*

(Continued)

*Primary Examiner* — William M Pierce
(74) *Attorney, Agent, or Firm* — Stetina Brunda Garred and Brucker; Mark B. Garred

(57) ABSTRACT

A golf club head includes a main body having a topline and an opposing sole. The main body includes a striking face extending between the topline and sole, and a rear face in opposed relation to the striking face. A sole body is proximate the rear face and extends at least partially along the sole. A peripheral flange extends at least partially about the rear face and is of a flange height, $H_F$, relative to the rear face. A truss protrudes from the rear face and includes a at least a first truss arm which is of a first truss arm height, $H_{T1}$, relative to the rear face, wherein the difference between $H_F$ and $H_{T1}$ is less than about 0.25 mm.

19 Claims, 4 Drawing Sheets

(56) References Cited

U.S. PATENT DOCUMENTS

D327,720 S * 7/1992 Antonious ..... D21/748
D332,478 S * 1/1993 Antonious ..... D21/749
5,377,985 A * 1/1995 Ohnishi ..... A63B 53/04 473/324
D359,539 S * 6/1995 Allen ..... D21/749
5,435,559 A * 7/1995 Swisshelm ..... A63B 53/04 473/291
5,547,194 A * 8/1996 Aizawa ..... A63B 53/04 473/350
5,669,826 A * 9/1997 Chang ..... A63B 53/04 473/332
5,676,605 A * 10/1997 Kobayashi ..... A63B 53/04 473/331
5,921,869 A * 7/1999 Blough ..... A63B 53/04 473/291
6,193,614 B1 2/2001 Sasamoto et al.
6,210,290 B1 4/2001 Erickson et al.
6,350,407 B1 2/2002 Sakata et al.
6,368,231 B1 4/2002 Chen
6,695,714 B1 * 2/2004 Bliss ..... A63B 53/047 473/328
6,811,496 B2 * 11/2004 Wahl ..... A63B 53/047 473/334
6,855,066 B2 * 2/2005 Best ..... A63B 53/04 473/291
6,857,973 B2 * 2/2005 Wieland ..... A63B 53/047 473/342
6,887,164 B2 * 5/2005 Dewanjee ..... A63B 53/047 473/342
D554,217 S * 10/2007 Ruggiero ..... D21/759
D554,218 S * 10/2007 Ruggiero ..... D21/759
7,399,238 B2 * 7/2008 Hocknell ..... A63B 53/0466 473/342
D581,000 S * 11/2008 Nicolette ..... D21/749
D602,103 S * 10/2009 Jorgensen ..... D21/747
D621,893 S * 8/2010 Nicolette ..... D21/759
D635,627 S * 4/2011 Nicolette ..... D21/759
D643,492 S * 8/2011 Nicolette ..... D21/759
8,202,174 B2 * 6/2012 Breier ..... A63B 53/047 473/332
8,574,094 B2 * 11/2013 Nicolette ..... A63B 53/047 473/291
8,657,700 B2 * 2/2014 Nicolette ..... A63B 53/047 473/291
8,753,230 B2 * 6/2014 Stokke ..... A63B 53/047 473/350
8,961,336 B1 * 2/2015 Parsons ..... A63B 53/0475 473/332
9,079,080 B2 * 7/2015 Jertson ..... A63B 53/047
9,849,355 B2 * 12/2017 Seagram ..... A63B 53/047
D809,082 S * 1/2018 Kim ..... D21/759
D812,169 S * 3/2018 Kim ..... D21/759
D815,705 S * 4/2018 Dolezel ..... D21/749
2001/0001774 A1 * 5/2001 Antonious ..... A63B 53/04 473/349
2001/0055996 A1 12/2001 Iwata et al.
2002/0004426 A1 1/2002 Lin et al.
2002/0042307 A1 4/2002 Deshmukh
2002/0098910 A1 * 7/2002 Gilbert ..... A63B 53/04 473/332
2010/0130306 A1 * 5/2010 Schweigert ..... A63B 53/04 473/350
2010/0267463 A1 * 10/2010 Stites ..... A63B 60/02 473/291
2011/0207551 A1 * 8/2011 Breier ..... A63B 53/047 473/332
2012/0289360 A1 * 11/2012 Breier ..... A63B 53/047 473/335
2013/0109500 A1 * 5/2013 Boyd ..... A63B 53/047 473/332

OTHER PUBLICATIONS

Cleveland RTX-3, https://global.rakuten.com/en/store/advancesports/item/n180604-07/, dated from design patent D815,705, Apr. 2018.*
Cleveland Golf RTX-3, Product Manual, http://www.clevelandgolf.eu/on/demandware.static/-/Sites-Cleveland-EU-Library/default/dw4ae853c1/pdf/RTX-3_Product-Manual_EU.pdf, Sep. 2020.*
Cover and p. 296 of Pro-Go Golf Equipment Catalogue, 1995, 2 Pages.

* cited by examiner

TRUSSES FOR GOLF CLUB HEADS

CROSS-REFERENCE TO RELATED APPLICATIONS

This application is a continuation of prior U.S. application Ser. No. 14/310,718 filed Jun. 20, 2014, the contents of which are expressly incorporated herein by reference.

STATEMENT RE: FEDERALLY SPONSORED RESEARCH/DEVELOPMENT

Not Applicable

BACKGROUND OF THE INVENTION

1. Field of the Invention

The present disclosure pertains generally to golf clubs and, more particularly, to a golf club head that includes a uniquely configured arrangement of trusses and a peripheral flange which are arranged relative to each other to improve finishing operations, such finishing operations being used, for example, to smooth or polish all trusses and the peripheral flange to a similar degree.

2. Description of the Related Art

Golf club design is primarily driven by a desire to achieve enhanced physical performance of the golf club. For instance, a golf club may be particularly configured to achieve greater distance, more forgiveness, or a particular vibrational resonance upon golf ball impact to create a more desirable "feel" and sound.

In addition to enhanced physical performance of the golf club, the look or aesthetics of the club also factor into the overall design. Golfers are more likely to perform better when they feel confident about their equipment, and thus, designers strive to create a golf club which is not only capable of achieving enhanced physical performance, but also creates an attractive appearance which provides confidence to the golfer.

One structural feature that has been incorporated into many golf club heads (notably wedges and irons) for improving their physical performance are trusses, which may have a vibration-dampening effect on the club head upon impact with a golf ball. FIGS. 1, 1A, and 1B show a prior art golf club head 10. The club head 10 generally includes a striking face 12, a rear face 14 disposed in opposed relation to the striking face 12, a shaft accommodating hosel 15 which protrudes from a heel end 11 of the striking face 12, and a peripheral flange 16 which at least partially circumvents the rear face 14 and defines an outer surface 36. The opposed ends of the peripheral flange 16 transition to a lower body 18 of the club head 12. The lower body 18 defines a sole portion 20 and an inclined rear surface 22. The inclined rear surface 22 from the sole portion 20 at least partially defines one or more cavities 24. As shown in FIG. 1, the cavity 24 accommodates an insert 25, which may include branding or other indicia, as is common in club head design.

The club head 10 additionally includes a truss 26 formed on and extending along prescribed portions of the rear face 14 of the club head 10. The truss 26 is specifically configured to achieve the desired physical performance enhancing characteristics, e.g., vibration dampening, without compromising other specifically tuned structural characteristics of the club head 10, such as mass distribution, center of gravity, etc. The truss 26 generally includes a base segment 28 and one or more arm segments 30, 32 extending from a common side of the base segment 28 in spaced relation to each other. The cavity 24 is located between the base segment 28 and the lower body 18, and is partially defined by each.

The truss 26 is of a truss height $T_H$ relative to the rear face 14, and a truss width $T_W$ as generally defined by the distance between the opposed longitudinal edges of each of the base and arm segments 28, 30, 32 of the truss 26 at the top or outer surface 34 thereof. Furthermore, the peripheral flange 16 is of a flange height $F_H$ relative to the rear face 14. In one particular prior art club head 10, the truss height $T_H$ is about 0.92 mm, the truss width $T_W$ is about 2 mm, and the flange height $F_H$ is about 1.2 mm. In this respect, since the truss height $T_H$ is less than the flange height $F_H$, the truss 26 is recessed relative to the peripheral flange 16.

One of the final steps in forming the club head 10 is to create a desirable surface texture scheme which enhances the overall appearance of the club head 10. The surface texture scheme may include several different surface textures on discrete regions of the club head 10, which produces different reflective surfaces on the club head 10. The surface texturing may be achieved by blasting and polishing different regions of the club head 10. The polishing may entail the use of a polishing wheel which contacts prescribed surfaces of the club head 10 to create a particular surface finish associated with the desired surface texture.

One particular limitation associated with polishing the club head 10 is that the polishing wheel can only effectively polish the outermost surfaces of the club head 10. In other words, surfaces which are recessed or reside below an adjacent surface typically cannot be easily reached with a polishing wheel, and thus, those surfaces are typically blasted, which produces a surface that has a higher surface roughness value than a polished surface.

As noted above, in conventional club heads, such as the club head 10, the outer surface 34 of the truss 26 resides below adjacent surfaces on the club head 10. As illustrated in greater detail in FIGS. 1A and 1B, the outer surface 34 of the truss 26 is offset from, and resides below, the adjacent outer surface 36 of the peripheral flange 16 by an offset amount "O," wherein the offset amount O is equal to the difference between the flange height $F_H$ and the truss height $T_H$. Thus, if the flange height $F_H$ is equal to 1.2 mm and the truss height $T_H$ is equal to 0.92 mm, the offset amount O is equal to 0.28 mm, which is large enough to prevent a polishing wheel from reaching the truss 26, and in particular the outer surface 34 thereof.

Furthermore, the inclined rear surface 22 oftentimes extends over a portion of the truss 26 (i.e., the base segment 28), such portion being labeled with the reference number 35 in FIGS. 1A and 1B. In this respect, the club head 10 includes two "steps" between the inclined surface 22 and the rear face 14, wherein the "first step" is between the inclined surface 22 and the truss 26, and the "second step" is between the truss 26 and the rear face 14. The recessed nature of the truss outer surface 34 effectively prevents the polishing wheel from easily contacting or engaging the same. As such, the truss 26 is oftentimes textured with the rear face 14 of the club head 10, typically via blasting, which results in a dull appearance, the truss 26 thus merely blending in with the rear face 14 of the club head 10.

In view of the aforementioned deficiencies in the art, there is a need for a club head having a truss that is specifically configured and adapted to enable polishing of the truss so as to create a contrast with an underlying rear face to produce a more visually striking appearance of the truss.

BRIEF SUMMARY OF THE INVENTION

Various aspects of the present disclosure are directed toward a club head having a truss defining an outer truss surface, at least portions of which may be substantially co-planar with the outer flange surface of an adjacent peripheral flange. In this respect, the outer truss surface is not significantly recessed or stepped below the outer flange surface, which allows the outer truss surface to be polished along with the outer flange surface using a conventional polishing wheel. Thus, the outer truss surface may have a polished finish relative to an underlying rear face, which provides a striking visual contrast and desirable aesthetic appearance without compromising the physical performance of the club head.

According to one embodiment, there is provided a golf club head comprising a main body having a topline and an opposing sole. The main body includes a striking face extending between the topline and sole, and a rear face in opposed relation to the striking face. A sole body proximate the rear face extends at least partially along the sole. A peripheral flange extends at least partially along the rear face, and is of a flange height, $H_F$, relative to the rear face. A truss protrudes from the rear face and may include at least a first truss arm which may have a first truss arm height, $H_{T1}$, relative to the rear face, wherein the difference between $H_F$ and $H_{T1}$ may be less than about 0.25 mm.

The truss may further include a second truss arm which may protrude from the rear face in spaced relation to the first truss arm and may have a second truss arm height, $H_{T2}$, relative to the rear face, wherein the difference between $H_F$ and $H_{T2}$ may be less than about 0.25 mm. The peripheral flange may define an outer flange surface which may be separated from the rear face by the flange height $H_F$, the first truss arm may define an outer first truss arm surface which may be separated from the rear face by the first truss arm height $H_{T1}$, and the second truss arm may define an outer second truss arm surface which may be separated from the rear face by the second truss arm height $H_{T2}$. The outer flange surface may be separated from each of the outer first and second truss arm surfaces by respective ones of a pair of channels.

The rear face may be of one surface roughness, and the outer flange surface and the outer first and second truss surfaces may each be of a another surface roughness which is different from that of the rear face such that the outer flange surface and the outer first and second truss surfaces are less coarse than the rear face.

The rear face may be of one light reflectance value, and the outer flange surface and the outer first and second truss surfaces may each be of another light reflectance value which is different from that of the rear face such that the outer flange surface and the outer first and second truss surfaces are more reflective than the rear face.

The truss may further comprise a truss spine which extends at least partially along the sole body and defines an outer truss spine surface, the first and second truss arms may each be integrally connected to the truss spine. The first and second truss arms may extend from a common side of the truss spine.

The outer flange surface may be separated from the outer truss spine surface by a spaced pair of channels.

The sole body may define a sole incline which extends along the outer truss spine surface and is separated therefrom by a channel. The rear face may be of a first surface roughness, the sole body may define a sole incline which extends along the outer truss spine surface and is of a second surface roughness different from the first surface roughness such that the sole incline is less coarse that the rear face. The outer flange surface, the outer first and second truss surfaces, and the outer truss spine surface may each be of a third surface roughness different from both the first surface roughness and the second surface roughness such that the outer flange surface, the outer first and second truss surfaces, and the outer truss spine surface are each less coarse that the sole incline.

According to another embodiment, there is provided a golf club head including a main body having a topline and an opposing sole. The main body includes a striking face, and a rear face in opposed relation to the striking face. The main body further comprises a truss defining an outer truss surface and segregating the rear face into at least two surface regions. Each of two surface regions is of one surface roughness, and the outer truss surface is of another surface roughness different than that of the two surface regions such that the outer truss surface is less coarse than the two surface regions.

The various exemplary aspects described above may be implemented individually or in various combinations. These and other features and advantages of the golf club head according to the disclosure in its various aspects and demonstrated by one or more of the various examples will become apparent after consideration of the ensuing description, the accompanying drawings, and the appended claims.

BRIEF DESCRIPTION OF THE DRAWINGS

The drawings described below are for illustrative purposes only and are not intended to limit the scope of the present invention in any way. Exemplary implementations will now be described with reference to the accompanying drawings, wherein.

Common reference numerals are used throughout the drawings and detailed description to indicate like elements.

DETAILED DESCRIPTION OF THE INVENTION

Figure 1:
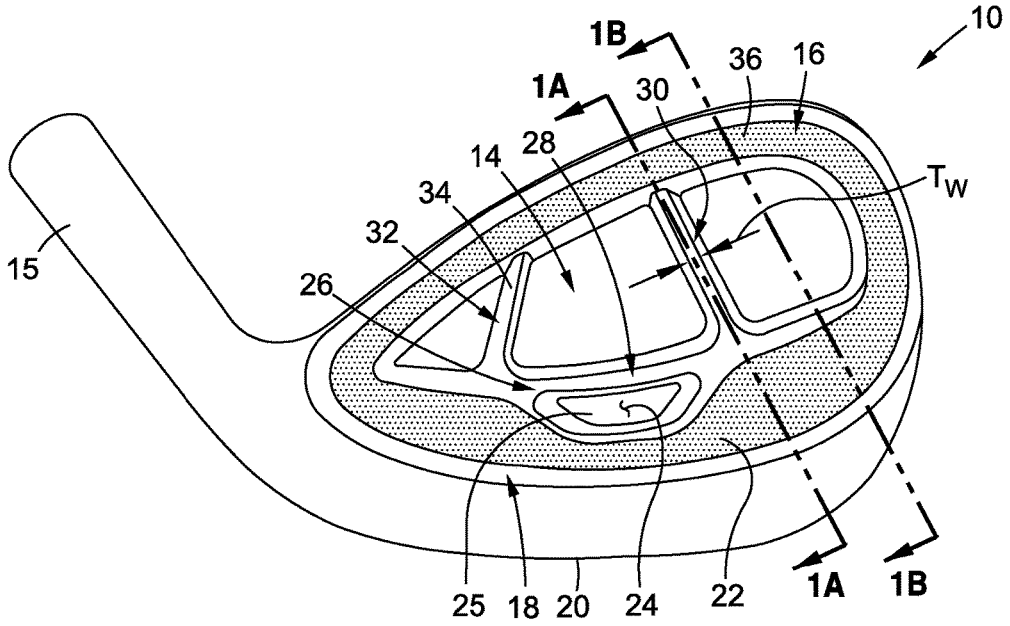
FIG. 1 (Prior Art)
FIG. 1 is a rear view of an exemplary, prior art iron or wedge-type club head.
Figure 1A:
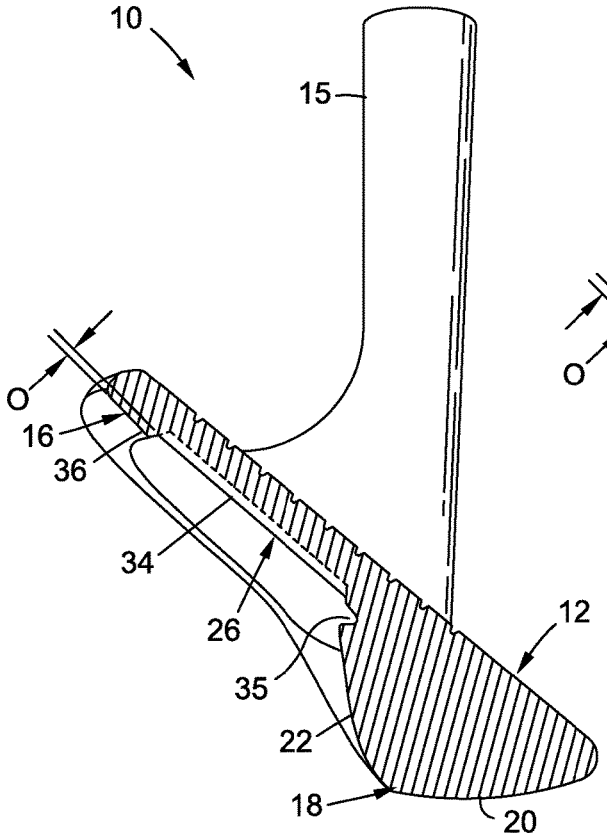
FIG. 1A (Prior Art)
FIG. 1A is a cross-sectional view of the prior art club head depicted in FIG. 1, taken along axis 1A-1A.
Figure 1B:
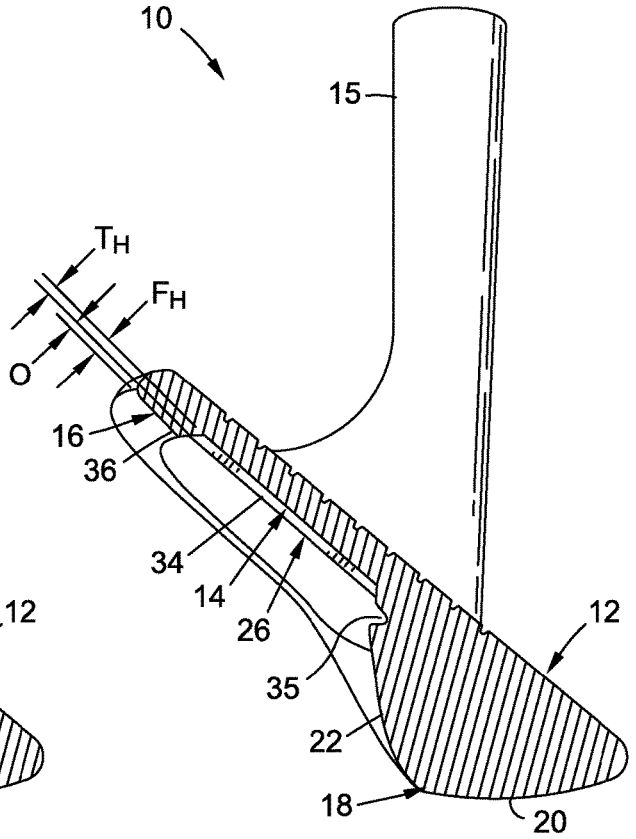
FIG. 1B (Prior Art)
FIG. 1B is a cross sectional view of the prior art club head depicted in FIG. 1, taken along axis 1B-1B.
Figure 2:
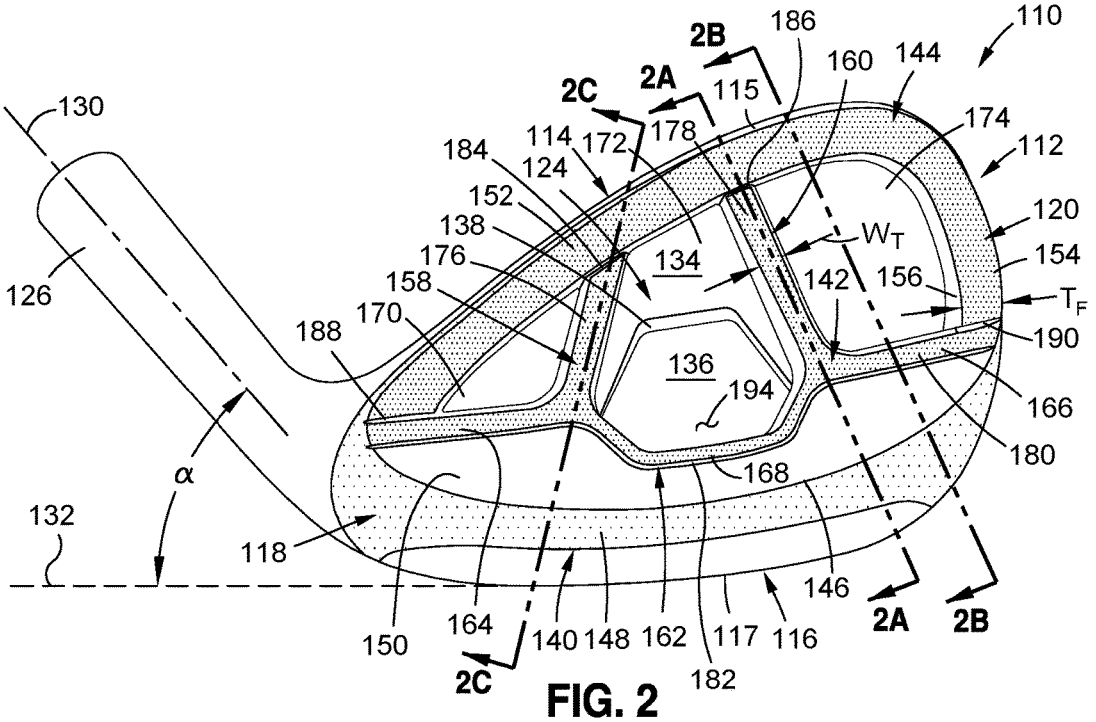
FIG. 2 is a rear view of an exemplary iron or wedge-type club head constructed in accordance with an embodiment of the present disclosure.
Figure 2A:
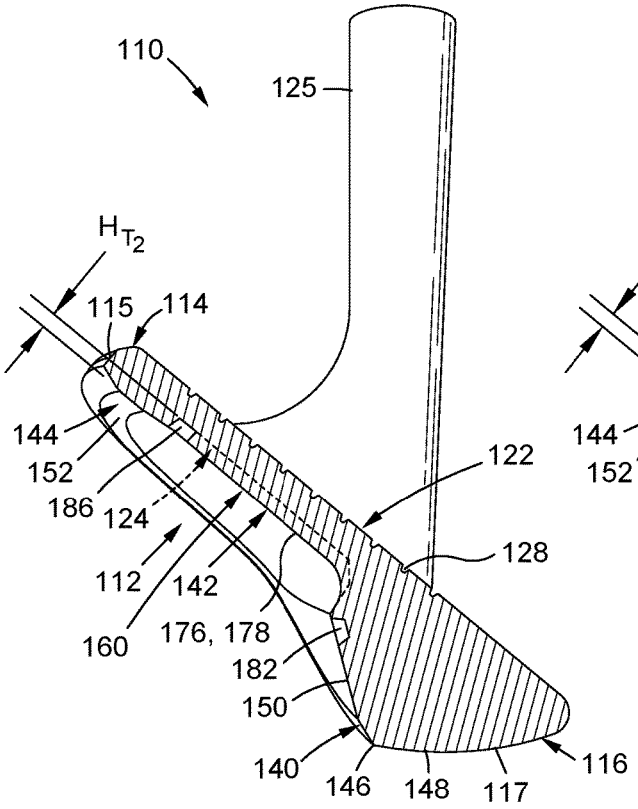
FIG. 2A is a cross-sectional view of the club head depicted in FIG. 2, taken along axis 2A-2A.
Figure 2B:
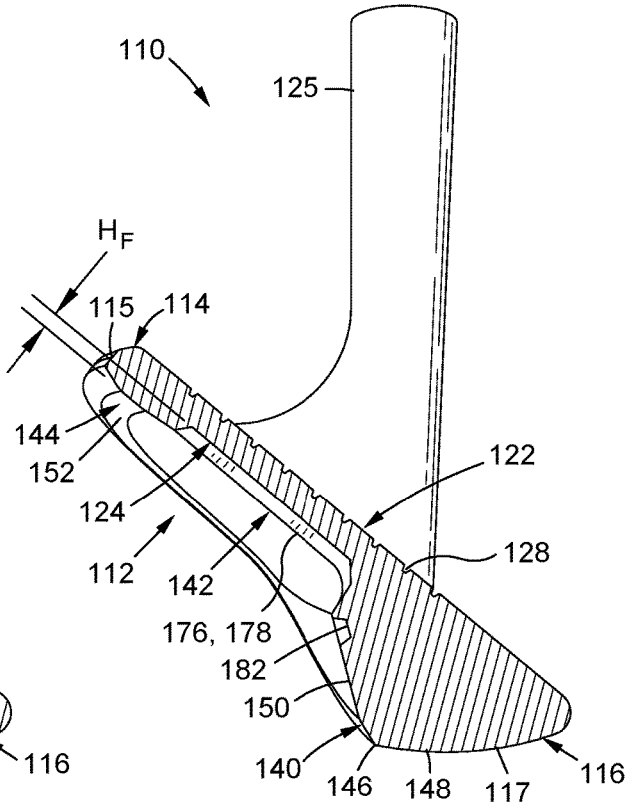
FIG. 2B is a cross-sectional view of the club head depicted in FIG. 2, taken along axis 2B-2B.
Figure 2C:
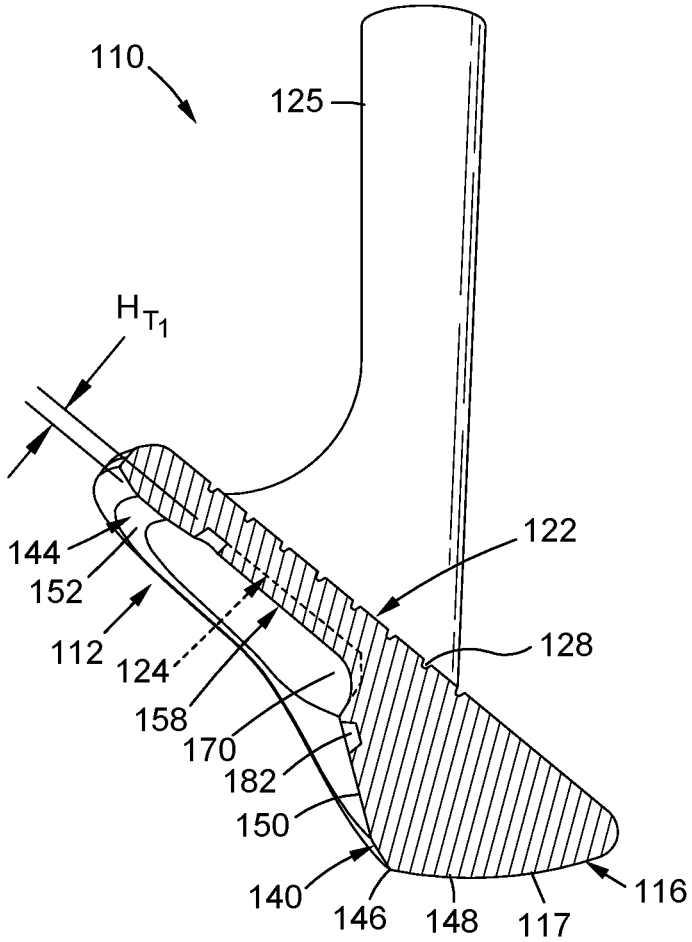
FIG. 2C is a cross-sectional view of the club head depicted in FIG. 2, taken along axis 2C-2C.

Referring now to the drawings, wherein the showings are for purposes of illustrating various aspects of the present disclosure only, and not for purposes of limiting the same, FIGS. 2, 2A, and 2B depict a golf club head 110 constructed in accordance with an embodiment of the present disclosure.

In one or more aspects of the present disclosure, and as depicted by way of example in FIGS. 2, 2A, and 2B, the golf club head 110 is a head for the category of golf clubs generally characterized as "irons" or "wedges." Irons are often numbered, for example 2-iron through 9-iron, with higher numbers corresponding to higher loft angles. Wedges are often classified as "pitching," "gap," "sand," and "lob" wedges, depending of the loft angle, i.e., degree of inclination of the striking face thereof, which generally falls in the range of from 46° to 64°. However, those of ordinary skill in the art will recognize that the principles of the present disclosure, as will be described in more detail below, may be applicable to other types of golf club heads including irons, hybrids, woods, putters, etc.

The golf club head 110 includes a main body 112. When viewed from the perspectives shown in FIGS. 2, 2A and 2B, the main body 112 includes a top portion 114 defining a top line 115, and a bottom portion 116 which is generally opposite the top portion 114 and defines a sole 117. The main body 112 also includes a heel portion 118, a toe portion 120 which is generally opposite the heel portion 118, a striking face 122, and a rear face 124 which is generally opposite the striking face. Still further, the main body 112 includes a hosel 125 which, as is seen in FIGS. 2, 2A and 2B, is generally located at the heel side of the top portion 114 proximate the striking face 122. The hosel 125 is used to facilitate the attachment of a club shaft (not shown) to the golf club head 110.

In the golf club head 110, the main body 112 is typically fabricated predominantly from a metallic material, e.g., stainless steel, titanium, or other metals and alloys thereof. In greater detail, it is contemplated that at least the main body 112 may be fabricated from a metal material having an elongation greater than or equal to about 10% so as to facilitate the formation thereof by forging, bending, pressing, stamping or another similar, suitable technique. As employed herein, the phrases "greater than or equal to" and "not less than" may be used interchangeably. Similarly, the phrases "less than or equal to" and "not greater than" may be used interchangeably.

As is typical for iron and wedge type golf clubs, the striking face 122 is generally planar or flat, and suitable for striking a golf ball. Those of ordinary skill in the art will recognize that the striking face 122, though being described as generally planar, may possess some degree of bulge and/or roll, depending on the club type. Those of ordinary skill in the art will further recognize that the specific shape or profile of the striking face 122, and the club head 110 in general, as shown in FIGS. 2, 2A, and 2B is exemplary only, and may be selectively varied without departing from the spirit and scope of the present disclosure. Along these lines, this specific shape or contour of the top, bottom, heel and toe portions 114, 116, 118, 120 of the main body 112 as shown in FIGS. 2, 2A, and 2B is also exemplary only, and may itself be selectively varied without departing from the spirit and scope of the present disclosure.

According to one implementation, the club head 110 includes a plurality of grooves 128 extending into the club head 110 from the striking face 122. The exemplary grooves 128 are generally parallel to each other and may extend in a horizontal direction when the club head is in a "reference position." In FIGS. 2, 2A, and 2B the golf club head 110 is depicted as being in a "reference position." When the golf club head 110 is in the reference position, a hosel axis 130 is oriented at a lie angle $\alpha$ of approximately 60° with respect to a horizontal ground plane 132. Unless otherwise indicated, all parameters herein are specified with the golf club head 110 in the reference position.

The club head 110 is uniquely configured to provide enhanced performance and feel when striking a golf ball. The rear face 124 is arranged in generally opposed relation to the striking face 122 and is generally planar and parallel to the striking face 122. In the exemplary embodiment, the rear face 124 may include a first portion 134, a second portion 136 which may be recessed into the club head 110 relative to the first portion 134, and a step portion 138 extending between and thus connecting the first portion 134 and the second portion 136. In the completed club head 110, the rear face 124 may be finished to be of a first surface roughness value, as will be described in more detail below.

The club head 110 includes several features proximate the rear face 124 to impart prescribed performance characteristics. Moving from the sole 117 to the top line 115 along the rear face 124, the club head 110 includes a sole body 140, a truss 142 and a peripheral flange 144. The sole body 140, sometimes referred to as the "muscle" of a wedge or iron type golf club head, which may define at least a portion of the sole 117 of the club head 110, extends between the heel portion 118 and the toe portion 120. The exterior surface of the sole body 140 defines a sole grind 148 and a sole incline 150 which are segregated from each other by a ridge 146. The sole grind 148 has a generally arcuate configuration, while the sole incline 150 is generally planar. The ridge 146 extends between the sole grind 148 and the sole incline 150 between the heel portion 118 and the toe portion 120. In the completed club head 110, the sole grind 148 and sole incline 150 may each be of a second surface roughness value that is less than the first surface roughness value associated with the rear face 124. With greater particularity, the sole grind 148 and sole incline 150 may be smoother than the rear face 124.

The peripheral flange 144 extends from the rear face 124, away from the striking face 122 and along the top line 115 of the club head 110 between the heel portion 118 and the toe portion 120. The peripheral flange 144 defines an outer flange surface 152. The peripheral flange 144 is of a flange height $H_F$ relative to the rear face 124. As seen in FIGS. 2A and 2B the flange height $H_F$ is measured between the outer flange surface 152 of the peripheral flange 144 and the first portion 134 of the rear face 124. The flange height $H_F$ may vary between a flange height minimum $H_{Fmin}$ and a flange height maximum $H_{Fmax}$ according to acceptable tolerance ranges. According to one embodiment, the flange height $H_F$ is equal to about 1.8 mm. The peripheral flange 144 is also of a flange thickness $T_F$ as defined by the distance between an outer flange edge 154 and an inner flange edge 156. Stated another way, the flange thickness $T_F$ can generally be characterized as the width of the outer flange surface 152 of the peripheral flange 144 which extends between the outer and inner flange edges 154, 156. In the exemplary embodiment, the flange thickness $T_F$ may be substantially uniform along the length of the peripheral flange 144; in other embodiments, however, the flange thickness $T_F$ may vary from one point to another along the perimeter of the peripheral flange 144. In the completed club head 110, the outer flange surface 152 may be finished to be of a third surface roughness value that may be different than the first and second surface roughness values associated with the rear face 124 and sole body 140, respectively. In this respect, the outer flange surface 152 may be smoother than the sole grind 148 and sole incline 150 of the sole body 144, and the first, second and step portions 134, 136, 138 of the rear face 124.

The club head 110 further includes the aforementioned truss 142 which protrudes outwardly relative to the rear face 124. As will be described in more detail below, a portion of the truss 142 may create a transition between each of the opposed ends of the peripheral flange 144 and the sole body 140. The truss 142 is configured to provide structural support to the striking face 122 such that when the club head 110 strikes the golf ball, the vibrations resulting from such impact are dampened to provide a desirable feel and sound. As will be discussed in more detail below, in the completed club head 110, prescribed surfaces of the truss 142 and the outer flange surface 152 may be finished through a polishing operation to be of substantially the same surface roughness (i.e., the third surface roughness value) and hence substantially the same appearance.

According to one embodiment, and referring now specifically to FIG. 2, the truss 142 may comprise a truss spine 162 which extends between the heel portion 118 and the toe portion 120 of the club head 110, generally along the sole body 140 thereof. The truss spine 162 as illustrated is itself comprised of a truss heel segment 164, a truss toe segment 166, and a truss cavity segment 168 extending between and connecting the truss toe segment 166 and truss heel segment 164. The truss 142 further comprises one or more, for example a pair of truss arms 158, 160 which may be integrally connected to and protrude from a common side of the truss spine 162, the distal ends of the each of the truss arms 158, 160 extending to the inner flange edge 156 of the peripheral flange 144.

In the exemplary embodiment of the truss 142 shown in FIGS. 2, 2A and 2B, the pair of truss arms 158, 160 extend along the rear surface 124 and segregate the rear surface 124 into three discrete rear surface regions 170, 172, 174. The first rear surface region 170, which may be defined solely by the first portion 134, is located adjacent the heel portion 118 of the club head 110 and is bounded by the first truss arm 158, the truss heel segment 164 and the heel segment of the peripheral flange 144. The second surface region 172, which is defined by the second portion 136 and at least a part of the first portion 134, is bounded by both truss arms 158, 160, the truss cavity segment 168, and the middle segment of the peripheral flange 144. The third surface region 174, which may also be defined solely by the first portion 134, is located near the toe portion 120 of the club head 110 and is bounded by the second truss arm 160, the truss toe segment 166, and the toe segment of the peripheral flange 144.

The truss arm 158 defines an outer truss arm surface 176, and the truss arm 160 defines an outer truss arm surface 178. The truss spine 162 defines an outer truss spine surface 180 which spans the heel, toe and cavity segments 164, 166, 168 thereof. The outer truss spine surface 180 is preferably substantially flush or co-planar with the sole incline 150 defined by the sole body 140. However, the club head 110 may preferably include an elongate groove or channel 182 formed therein which follows the contour of the truss spine 162 and creates a visual line of demarcation between the outer truss spine surface 180 and the sole incline 150. By virtue of the co-planar relationship between the outer truss spine surface 180 and the sole incline 150, only a single "step" is defined between the sole body 140 and each of the first and second portions 134, 136 of the rear face 124, such step being defined by the truss spine 162 of the truss 142. In greater detail, the truss heel segment 164 of the truss spine 162 defines a single step between the sole incline 150 and the first portion 134 of the rear face 124 at the first surface region 170, with the truss toe segment 166 of the truss spine 162 defining a single step between the sole incline 150 and the first portion 134 of the rear face 124 at the third surface region 174. The truss cavity segment 168 of the truss spine 162 defines a single step between the sole incline 150 and the second portion 136 of the rear face 124 at the third surface region 172.

The truss heel segment 164 of the truss spine 162 creates a transition between one end of the peripheral flange 144 and the sole body 140, with the truss toe segment 166 of the truss spine 162 creating a transition between the opposite end of the peripheral flange 144 and the sole body 140. Along these lines, the club head 110 further preferably includes a groove or channel 188 formed therein which creates a visual line of demarcation between the outer flange surface 152 and the outer truss spine surface 180 as defined by the truss heel segment 164 of the truss spine 162. A groove or channel 190 is also formed in the club head 110 and creates a visual line of demarcation between the outer flange surface 152 and the outer truss spine surface 180 as defined by the truss toe segment 166 of the truss spine 162. In a similar fashion, the club head 110 also preferably includes a groove or channel 184 formed therein which creates a visual line of demarcation between the outer truss arm surface 176 of the truss arm 158 and the outer flange surface 152, as well as a groove or channel 186 (also seen in FIG. 2A) formed therein which creates a visual line of demarcation between the outer truss arm surface 178 of the truss arm 160 and the outer flange surface 152.

In the club head 110, the truss arm 158 is of a truss arm height $H_{T1}$ as measured between the outer truss surface 176 and the first portion 134 of the rear face 124. Similarly, the truss arm 160 is of a truss arm height $H_{T2}$ as measured between the outer truss surface 178 and the first portion 134 of the rear face 124. The truss arm heights $H_{T1}$ and $H_{T2}$ may vary between respective truss height maximums, $H_{T\text{-}MAX}$ and truss height minimums, $H_{T\text{-}MIN}$ depending on acceptable tolerances. Furthermore, the outer truss arms surfaces 176, 178 are each of a prescribed truss width $W_T$ as defined by the distance between the opposed edges thereof.

Figure 3:
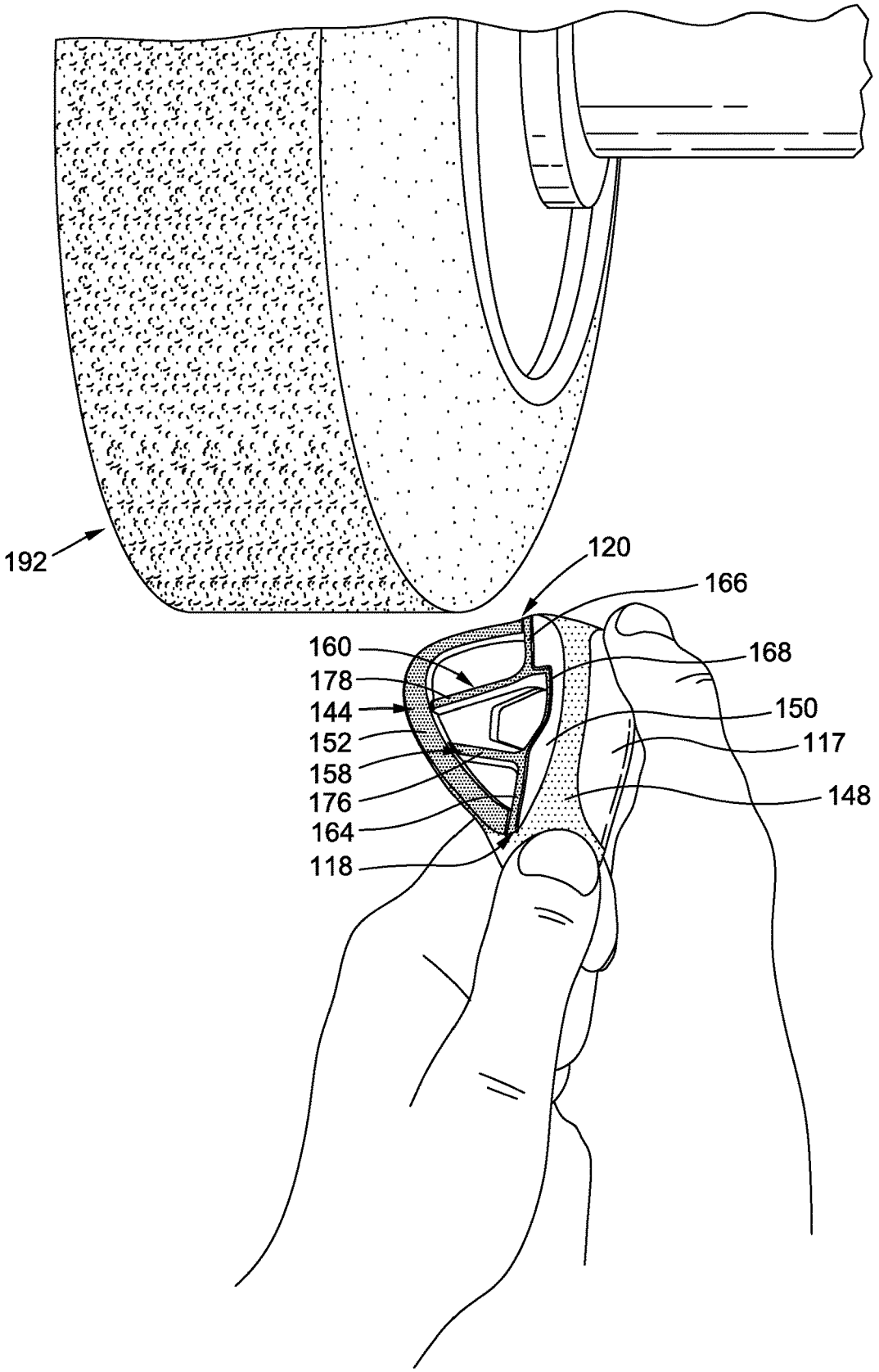
FIG. 3 is a perspective view of the club head shown in FIGS. 2, 2A and 2B as being polished with a polishing wheel.

According to one embodiment, the truss width $W_T$ is equal to about 3.3 mm and the truss arm heights $H_{T1}$ and $H_{T2}$ are equal to about 1.8 mm, which is substantially equal to the peripheral flange height $H_F$. As will be described in more detail below, the generally co-planar relationship between the outer truss arm surfaces 176, 178 and the outer flange surface 152 allows for polishing of the outer truss arm surfaces 176, 178 using a polishing wheel 192 (see FIG. 3). It is understood that the outer truss arm surfaces 176, 178 and the outer flange surface 152 may be slightly offset from each other; however, any offset will be minimal and allow the conventional polishing wheel 192 to operatively engage both the outer flange surface 152 and the outer truss arm surfaces 176, 178 to polish those surfaces 152, 176, 178 to a prescribed finish or surface roughness.

According to one embodiment, the club head 110 further includes a cavity 194 extending into a prescribed portion of the club head 110. The cavity 194 is collectively defined by the recessed second portion 136 and step portion 138 of the rear face 124 in combination with the truss cavity segment 168 of the truss spine 162. An insert (not shown) may be placed within the cavity 194 to alter the weight distribution and center of gravity of the club head 110 to tune the performance of the club head 110 and/or to provide branding indicia.

With the basic structural features of the club head 110 having been described above, the following discussion will focus on one exemplary finishing process for the club head 110, particularly the process of creating a desired texture scheme having prescribed surface roughness values on prescribed regions of the club head 110. The club head 110 may be cast or forged to include the structural attributes described above. After the casting or forging, the rear face 124 of the club head 110 is textured to the first surface roughness value. The rear face 124 may be textured by blasting the rear face 124 with steel shot and then glass bead, although other texturing techniques known by those skilled in the art may also be used.

After the rear face 124 has been textured, the remaining outermost surfaces of the club head 110 are polished using the polishing wheel 192. In particular, the polishing wheel 192 is used on the striking face 122, the sole 117, the sole grind 148 and the sole incline 150 of the sole body 140, the truss 142, and the peripheral flange 144. In greater detail, though the polishing wheel 192 is able to engage and thus polish the outer flange surface 152, the outer truss arm surfaces 176, 178, and the outer truss spine surface 180, it generally does not contact the inner flange edge 156 of the peripheral flange 144, or any side surface of the truss 142, and in particular the side surfaces of the truss arms and spine 158, 160, 162. As noted above, the generally co-planar relationship between the outer flange surface 152 and the outer truss surfaces 176, 178 of the truss arms 158, 160 allows the polishing wheel 192 to operatively engage therewith, in addition to the polishing wheel 192 engaging the outer truss spine surface 180. In the event there is a slight offset between the outer flange surface 152 and the outer truss surfaces 176, 178, the polishing step may reduce the offset by reducing the greater one of the truss arm height $H_{T1}$, $H_{T2}$ or peripheral flange height $H_F$. The outer flange surface 152, the outer truss surfaces 176, 178, and the outer truss spine surface 180 are each preferably polished to the aforementioned third surface roughness value, which is preferably less than the first surface roughness value associated with the rear face 124.

After completing the polishing process using the polishing wheel 192, the texturing process further includes texturing the sole grind 148 and sole incline 150 to the second surface roughness value, which is less than the first surface roughness value associated with the rear face 124, but greater than the third surface roughness value associated with the outer flange surface 152, outer truss surfaces 176, 178, and outer truss spine surface 180. After masking off areas of the club head 110 other than the sole grind 148 and sole incline 150 which have been previously blasted or polished as to impart the first and third surface roughness values thereto, the unmasked sole grind 148 and sole incline 150 are textured by blasting the same with glass bead as imparts the second surface roughness value thereto.

After the club head 110 has been textured, the different surface roughness values formed on the various portions of the club head 110 produce different light reflection characteristics, with the surfaces that are of the third surface roughness value being highly reflective, the surfaces that are of the first surface roughness value being least reflective, and the surfaces that are of the second surface roughness value having intermediate reflective properties. The highly reflective nature of the outer flange surface 152, outer truss surfaces 176, 178, and outer truss spine surface 180 creates unique aesthetic attributes, particularly since those surfaces are contrasted with less reflective surfaces. Enhancing these aesthetic attributes are the channels 182, 184, 186, 188, 190, and in particular the channel 182 which separates the highly reflective outer truss spine surface 180 of the third surface roughness value from the less reflective sole incline 150 of the second surface roughness value. As will now be readily appreciated, the outer flange surface 152, outer truss surfaces 176, 178, and the outer truss spine surface 180 need not always have the same surface roughness or the same degree of reflectivity. As will also be appreciated, the other surfaces of the club, i.e., the reflective sole incline 150, sole grind 148, and rear face 124 need not have the same roughness or same degree of reflectivity. But in a preferred embodiment, the respective surface roughnesses of the outer flange surface 152, outer truss surfaces 176, 178, and the outer truss spine surface 180 may each be less course and/or more reflective than the respective surface roughnesses of the adjoining surfaces, i.e., the sole incline 150, rear face 124 surfaces, etc.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A golf club head comprising:

a main body having a topline portion, a sole portion opposite the topline portion, a heel portion, and a toe portion opposite the heel portion, the main body including:

a striking face;

a rear face in opposed relation to the striking face;

a muscle portion extending rearwardly from the rear face, the muscle portion defining a sole incline having a sole incline surface;

a peripheral flange extending at least partially along an upper edge of the rear face and spaced from the muscle portion, the peripheral flange extending from the rear face to define a height $H_F$ relative to the rear face and including an outer flange surface;

a truss arm having a truss arm sidewall and a truss arm outer surface, the truss arm sidewall extending between the rear face and the truss arm outer surface;

a truss spine extending over the rear face and being integrally connected to the truss arm such that the truss spine and the truss arm segregate the rear face into at least three surface regions, each of the at least three surface regions being recessed from the truss arm outer surface, the truss spine extending in a heel to toe direction adjacent each of the three surface regions and the sole incline, the truss spine having a truss spine sidewall and an outer truss spine surface, the truss spine sidewall extending between the rear face and the outer truss spine surface, the outer truss spine surface being integrally connected to the truss arm such that the truss arm outer surface extends directly from the outer truss spine surface so as to collectively form a continuous exposed surface, the truss arm outer surface and the outer truss spine surface collectively defining an outer truss surface spaced from the rear face by a height $H_T$;

a cavity within, and recessed relative to at least one of the three surface regions, the cavity at least partially delimited by the truss spine and a step portion located within the at least one of the three surface regions; and a first channel extending between the truss arm and the peripheral flange, and a second channel spaced from the first channel and extending along the peripheral flange, the first channel and the second channel recessed relative to the outer flange surface and the outer truss surface, wherein:

a difference between $H_F$ and $H_T$ is less than about 0.25 mm, the sole portion includes a sole grind surface, the rear face has a first surface roughness, the sole grind surface has a second surface roughness less than the first surface roughness, the outer truss surface has a third surface roughness less than the second surface roughness.

2. The golf club head as recited in claim 1, wherein the outer flange surface comprises the same surface roughness as the outer truss surface.

3. The golf club head as recited in claim 1, wherein $H_F$ and $H_T$ are equal.

4. The golf club head as recited in claim 1, wherein the sole incline surface comprises a surface roughness different from the respective surface roughnesses of the three surface regions and the outer truss surface such that the sole incline surface is less coarse than the three surface regions, and the outer truss surface is less coarse than the sole incline surface.

5. The golf club head as recited in claim 1, wherein each of the three surface regions comprise respective light reflectance values, and the outer truss surface comprises another light reflectance value different than that of the three surface regions such that the outer truss surface is more reflective than the three surface regions.

6. A golf club head comprising:

a main body having a topline portion, a sole portion opposite the topline portion, a heel portion, and a toe portion opposite the heel portion, the main body including:

a striking face extending between the topline portion and sole portion;

a rear face in opposed relation to the striking face a muscle portion extending rearwardly from the rear face the muscle portion defining a sole incline having a sole incline surface;

a peripheral flange extending at least partially along an upper edge of the rear face and spaced from the muscle portion, the peripheral flange extending from the rear face and including an outer flange surface having a flange height, $H_F$, relative to the rear face;

a first truss arm and a second truss arm both protruding from the rear face, the first truss arm comprising an outer first truss arm surface substantially coplanar with the outer flange surface and a first truss arm height, $H_{T1}$, relative to the rear face, the second truss arm comprising an outer second truss arm surface substantially coplanar with the outer flange surface and a second truss arm height, $H_{T2}$, relative to the rear face, the first truss arm and the second truss arm segregating the rear face into a first region proximate the heel portion and distal the toe portion, a second region proximate the toe portion and distal the heel portion, and a third region between the first region and the second region, the third region including a step portion, each of the regions of the rear face being recessed from the outer first truss arm surface and the outer second truss arm surface;

a truss spine extending over the rear face between the heel portion and the toe portion along the sole incline, the truss spine including a truss spine sidewall and an outer truss spine surface, the truss spine sidewall extending between the rear face and the outer truss spine surface, the outer truss spine surface being integrally connected to the first and second truss arms such that the outer truss spine surface extends directly from the outer first truss arm surface, and the outer second truss arm surface so as to collectively form a continuous exposed surface;

a cavity within the third region and recessed relative to the rear face, the cavity at least partially delimited by the truss spine and the step portion;

at least a first channel extending between the truss spine and the sole incline and recessed relative to the outer truss spine surface and the sole incline surface;

wherein:

$H_F$, $H_{T1}$, and $H_{T2}$ have a differential height of greater than 0 and less than about 0.25 mm the sole portion includes a sole grind surface, the rear face has a rear face surface roughness, the sole grind surface has a sole grind surface roughness less than the rear face surface roughness, at least one of the outer first truss arm surface and the outer second truss arm surface has an outer truss surface roughness less than the sole grind surface roughness.

7. The golf club head as recited in claim 6, further comprising a second channel spaced from the first channel, the first channel and the second channel located between, and recessed relative to the outer flange surface and at least one of the outer truss spine surface, the outer first truss arm surface, and the outer second truss arm surface.

8. The golf club head as recited in claim 7, further comprising a third channel extending along the truss spine and the sole incline and recessed relative to the outer truss spine surface and the sole incline surface.

9. The golf club head as recited in claim 6, wherein:

the outer flange surface and the outer first truss arm surface and outer second truss arm surface each comprise a surface roughness which is different from the rear face surface roughness such that the outer flange surface and the outer first truss arm surface and outer second arm truss surface are less coarse than the rear face surface roughness.

10. The golf club head as recited in claim 6, wherein:

the rear face comprises one light reflectance value; and the outer flange surface and the outer first truss arm surface and outer second truss arm surface each comprise light reflectance values which are different from that of the rear face such that the outer flange surface, the outer first truss arm surface, and the second truss arm surface are more reflective than the rear face.

11. The golf club head as recited in claim 6, wherein the first truss arm and second truss arm are each integrally connected to the truss spine.

12. The golf club head as recited in claim 11, wherein the first truss arm and second truss arm extend from a common side of the truss spine.

13. The golf club head as recited in claim 11, wherein:

the sole incline surface is of a sole incline surface roughness different from the rear face surface roughness such that the sole incline surface is less coarse that the rear face; and the outer flange surface, the outer first truss arm surface, the outer second truss arm surface, and the outer truss spine surface are each of a surface roughness different from both the rear face surface roughness and the sole incline surface roughness such that the outer flange surface, the outer first truss arm surface, and the outer second truss arm surface, and the outer truss spine surface are each less coarse that the sole incline surface.

14. The golf club head as recited in claim 6, wherein the outer flange surface is separated from the outer truss spine surface nearest the toe portion by a second channel and from the outer truss spine surface nearest the heel portion by a third channel.

15. The golf club head as recited in claim 6, wherein the golf club head has a loft of between 46 degrees and 64 degrees.

16. A golf club head comprising:

a main body having a topline portion, a sole portion opposite the topline portion, a heel portion, and a toe portion opposite the heel portion, the main body including:

a striking face;

a rear face in opposed relation to the striking face;

a muscle portion extending rearwardly from the rear face the muscle portion defining a sole incline having a sole incline surface;

a peripheral flange extending at least partially along an upper edge of the rear face and spaced from the muscle portion, the peripheral flange having a height $H_F$ relative to the rear face and including an outer flange surface;

a truss arm having an exposed outer truss arm surface, and a truss arm sidewall extending between the rear face and the outer truss arm surface, a height $H_T$ being defined as the distance between the outer truss arm surface and the rear face;

a truss spine connected to the truss arm such that the truss spine and truss arm segregate the rear face into a plurality of surface regions recessed from the outer truss arm surface, the truss spine extending over the rear face in a heel to toe direction adjacent each of the surface regions and the sole incline, the truss spine integrally connected to the truss arm and having an exposed outer truss spine surface and a truss spine sidewall extending between the outer truss spine surface and the rear surface, the truss spine surface extending directly from the outer truss arm surface so as to be a continuous extension of the outer truss arm surface;

a cavity within, and recessed relative to at least one of the surface regions, the cavity at least partially delimited by the truss spine and a step portion located within the at least one of the surface regions;

a first channel and a second channel spaced from the first channel, the first channel and the second channel located between, and recessed relative to the outer flange surface and the outer truss arm surface; and a third channel extending along the truss spine and the sole incline and recessed relative to the outer truss spine surface and the sole incline surface;

a difference between $H_F$ and $H_T$ is less than about 0.25 mm, the sole portion includes a sole grind surface, the rear face has a first surface roughness, the sole grind surface has a second surface roughness less than the first surface roughness, the outer truss arm surface has a third surface roughness less than the second surface roughness.

17. The golf club head as recited in claim 16, wherein the outer flange surface comprises the same surface roughness as the outer truss surface.

18. The golf club head as recited in claim 16, wherein $H_F$ and $H_T$ are equal.

19. The golf club head as recited in claim 16, wherein the sole incline surface comprises a surface roughness different from the respective surface roughnesses of the surface regions and the outer truss arm surface such that the sole incline surface is less coarse than the surface regions, and the outer truss arm surface is less coarse than the sole incline surface.

* * * * *